US005151035A

United States Patent [19]

Kawai et al.

[11] Patent Number: 5,151,035

[45] Date of Patent: Sep. 29, 1992

[54] ELECTRICAL CONNECTOR

[75] Inventors: Mitsuru Kawai; Masaru Yoshida; Yoshihiro Sasaki, all of Tokyo, Japan

[73] Assignee: Hirose Electric Co., Ltd., Tokyo, Japan

[21] Appl. No.: 741,958

[22] Filed: Aug. 8, 1991

[30] Foreign Application Priority Data

Sep. 13, 1990 [JP] Japan ..... 2-95564[U]

[51] Int. Cl.[5] ..... H01R 4/66

[52] U.S. Cl. ..... 439/95

[58] Field of Search ..... 439/95, 108, 608, 609, 439/620

[56] References Cited

U.S. PATENT DOCUMENTS 4,029,386 6/1977 Krantz et al. ..... 439/608

4,126,370 11/1978 Nijman ..... 439/608

*Primary Examiner*—Eugene F. Desmond

*Attorney, Agent, or Firm*—Kanesaka & Takeuchi

[57] ABSTRACT

An electrical plug (1) includes a conductive shell (6); an insulation housing (7) placed within the conductive shell and having at least one terminal mounting aperture (22); at least one detachable terminal (8) mounted in the terminal mounting apertures; a detachable ground terminal (9) mounted in the terminal mounting aperture; a retainer member (10) for retaining the detachable terminal and the detachable ground terminal; and a detachable ground member (23) attached to the ground terminal and having a comb contact (24) held between the conductive shell and the insulation housing.

3 Claims, 7 Drawing Sheets

ELECTRICAL CONNECTOR

BACKGROUND OF THE INVENTION

1. Field of the Invention

The present invention relates to multiple pole electrical connector for use in electronic equipment or the like.

2. Description of the Prior Art

FIGS. 16 and 17 show a conventional electrical connector of this type. The electrical connector includes a connector block 53 which has a cylindrical shell 54 made from a metal, an insulation housing 55 made from an insulator, and four terminals 56 supported by the insulation housing 55. The cylindrical shell 54 is provided at the front end with a coupling section 57 which is to be inserted into the receiving shell of a mating receptacle. One of the terminals 56 is used as a ground terminal 56*a* which is provided with a grounding spring contact 59 with a screw 58. The front end of the grounding spring contact 59 is brought into contact with the inside wall 60 of the coupling section 57 for providing grounding.

In the conventional electrical connector, when used in places subjected to vibrations or frequently plugging actions, the screw 58 for affixing the ground spring contact 59 to the ground terminal 56*a* can become loose, making unstable the contact between the ground terminal 56 and the ground spring contact 59.

In addition, the ground spring contact 59 is exposed so that falling metallic pieces, for example, can cause shortcircuit. When the ground spring contact 59 is replaced by a wire braid, a loose wire can make a short circuit.

SUMMARY OF THE INVENTION

Accordingly, it is an object of the invent provide a multiple pole electrical connector which is able to keep a stable contact between the ground terminal and the ground spring contact for use in places which are subjected to vibrations or frequent plugging actions.

It is another object of the invention to provide a multiple pole electrical connector which is protected against shortcircuit caused by falling metal pieces, etc.

According to the invention there is provided an electrical plug which a conductive shell made from a conductive material; an insulation housing placed within the conductive shell and having at least one terminal mounting aperture; at least one detachable terminal mounted in the terminal mounting aperture; a detachable ground terminal mounted in the terminal mounting aperture; a retainer member for retaining the detachable terminal and the detachable ground terminal in the insulation housing; and a detachable ground member with a circular mount strap attached to the ground terminal and having a linkage piece held between the retention member and the insulation housing.

Since the ground member is held between the retainer member and the insulation housing, the contact plug is useful in places which are subjected to vibrations and/or frequent plugging operations. In addition, the ground member is not exposed so that there is little or no danger of causing shortcircuit by falling metal pieces, etc. and coming into contact with the hand, thereby increasing the safety of the operator.

DESCRIPTION OF THE PREFERRED EMBODIMENT

Figure 1:
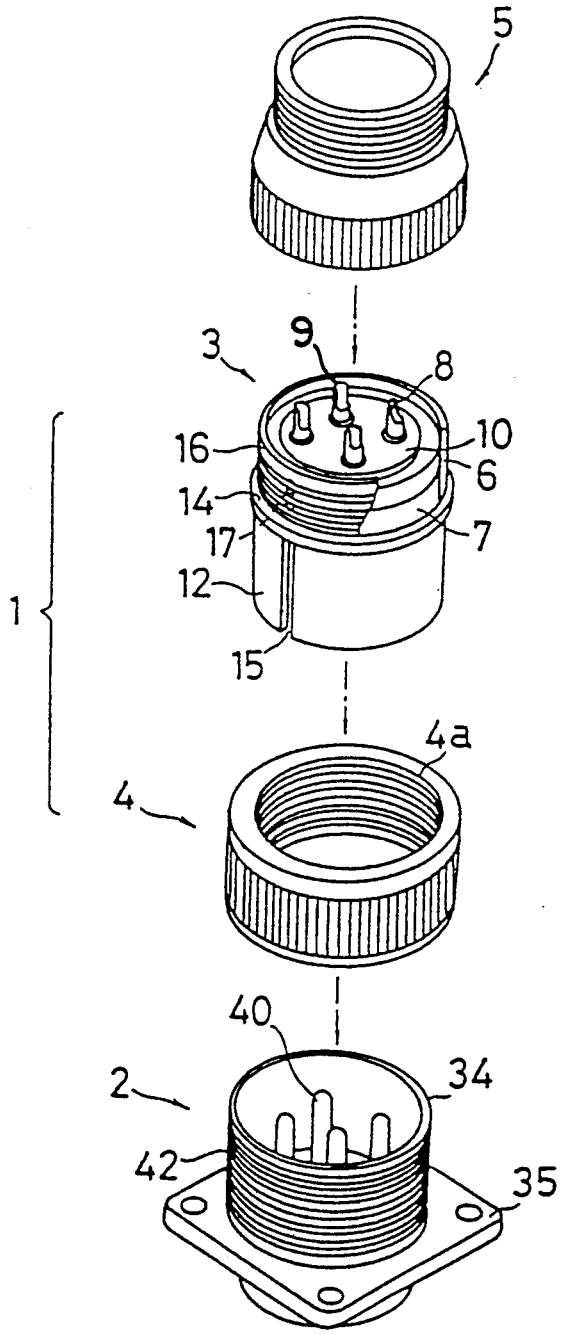
FIG. 1 exploded perspective view of an electrical connector consisting of a connector plug and a connector receptacle a to an embodiment of the invention.

In FIG. 1, a multiple pole electrical connector consists of an electrical plug 1 and an electrical receptacle 2. The electrical plug 1 includes a plug block 3, a coupling ring 4, and a cord ring 5. The plug block 3 includes a cylindrical shell 6 made from a metal; an insulation housing 7 placed within the cylindrical shell 6, and three female terminals 8 and one ground terminal 9 supported by the insulation housing 7.

Figure 2:
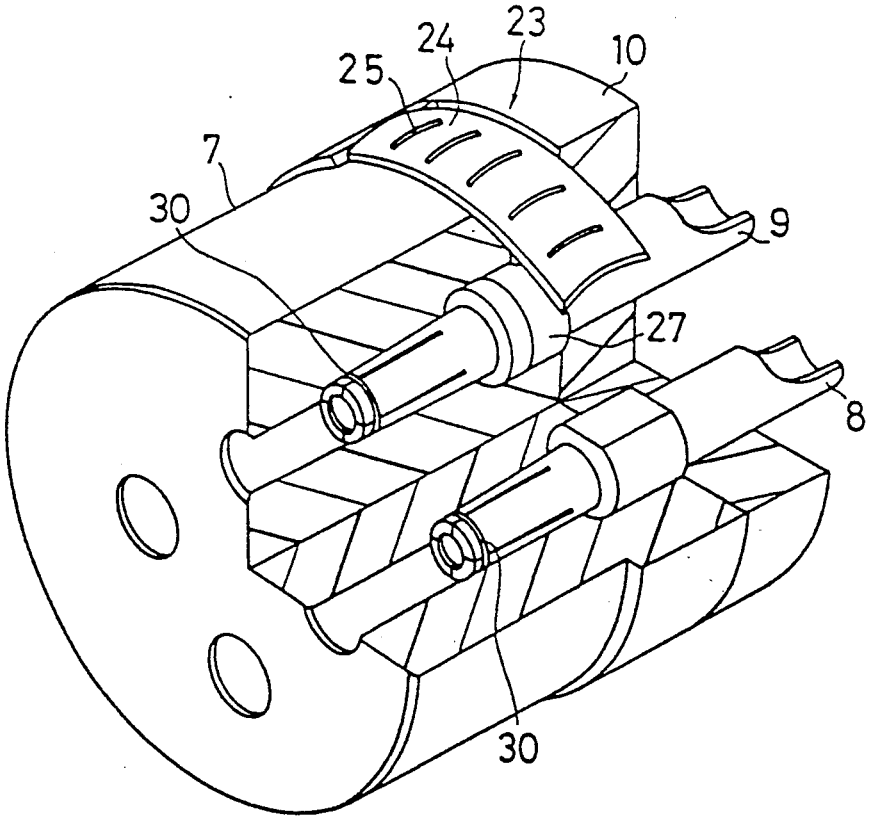
FIG. 2 is a partially cutaway perspective view of an insulation housing of the connector plug.
Figure 3:
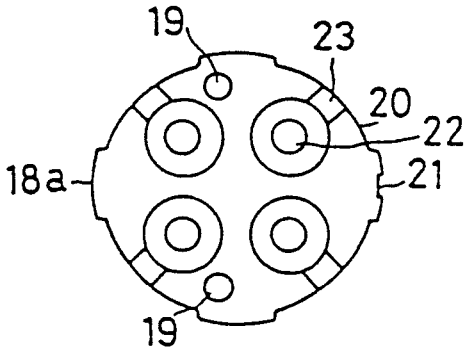
FIG. 3 is a rear elevational view of the insulation housing.
Figure 4:
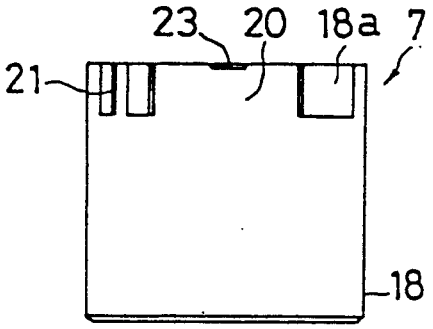
FIG. 4 is a side view of the insulation housing.
Figure 5:
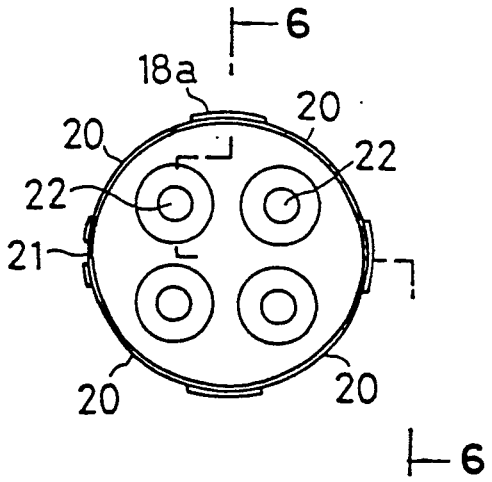
FIG. 5 is a front elevational view of the insulation
Figure 6:
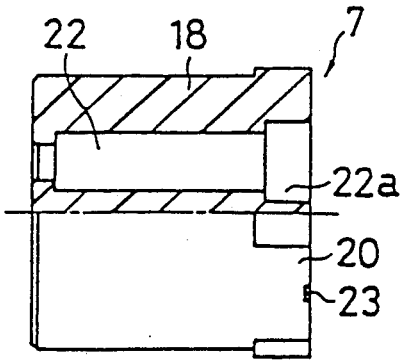
FIG. 6 is a partially sectional side view taken along line 6—6 of FIG. 5.

In FIG. 2, a grounding member 23 is affixed to the ground terminal 9 and held between the insulation housing 7 and a retainer member 10.

Figure 15:
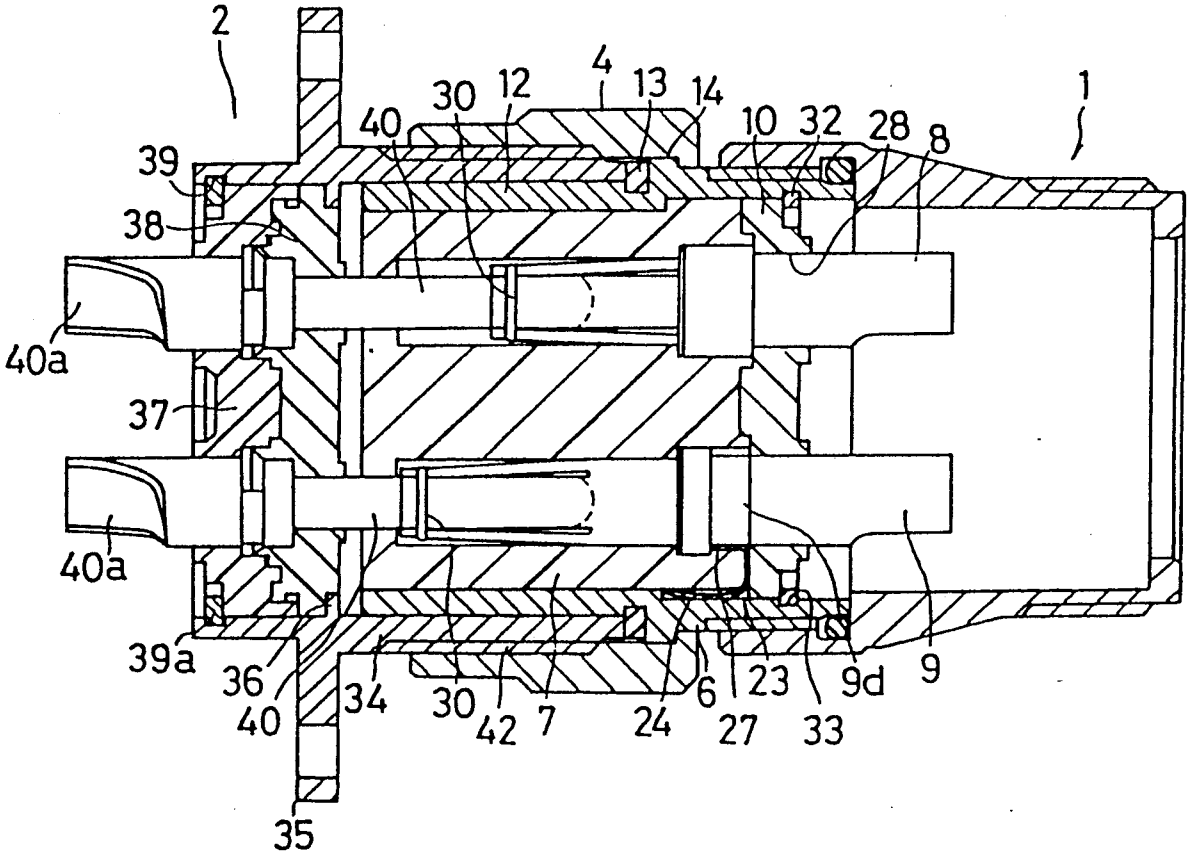
FIG. 15 is a longitudinal section of the connector plug and receptacle.
Figure 16:
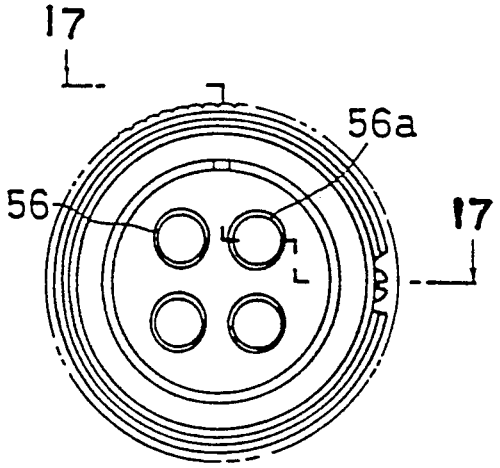
PRIOR ART FIG. 16
FIG. 16 is a front view of a conventional electrical connector.
Figure 17:
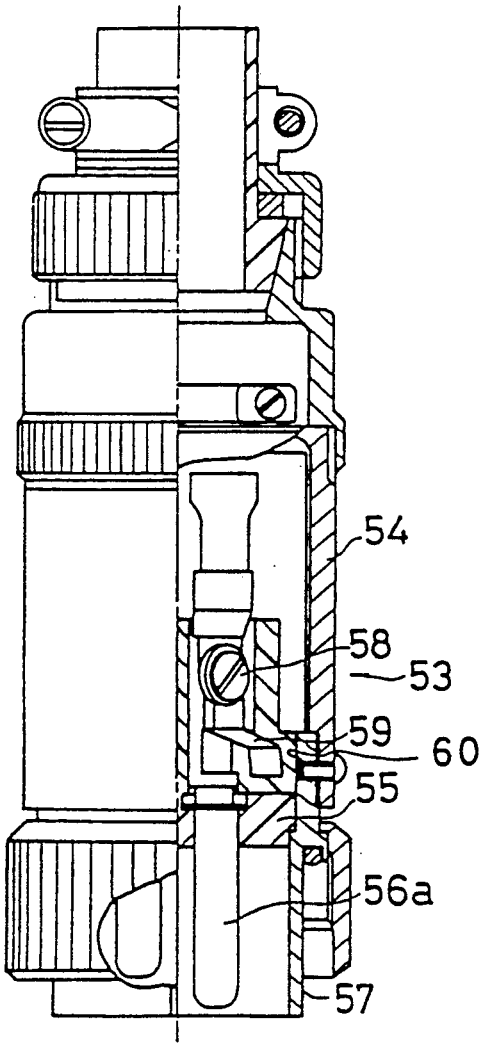
PRIOR ART FIG. 17
FIG. 17 is a partially sectional side view taken along line 17—17 of FIG. 16.

Referring back to FIG. 1, the cylindrical shell 6 has a coupling section 12 in the front portion and an outer flange 14 in the middle portion for engaging the coupling ring 4 and a packing 13 (FIG. 15). The coupling section 12 has an axial slit 15 as a guide. The rear portion of the cylindrical shell 6 has an exterior thread 16 and an inner ridge 17 extending in the axial direction for serving as a guide.

In FIGS. 3–6, the insulation housing 7 has a cylindrical block 18 made from a synthetic resin. The cylindrical block 18 has an enlarged rear section 18*a* on the side wall of which four ground member mounting recesses 20 are formed at regular intervals and one guide channel 21 between two of the mounting recesses 20. Four terminal mounting apertures 22 are formed through the cylindrical block 18 on the lines each including the center of the grounding member mounting recess 20 and the center of the cylindrical block 18. Each terminal mounting aperture 22 has an enlarged rear portion 22*a*. Each ground member mounting recess 20 and each terminal mounting aperture 22 are linked with a channel 23. A couple of positioning holes 19 are formed on the rear face of the cylindrical block 18.

Figure 7:
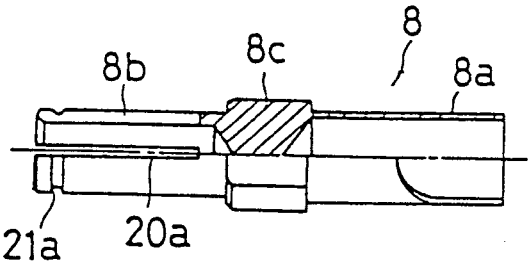
FIG. 7 is a partially cutaway side elevational view of a female terminal.

In FIG. 7, the female terminal 8 has a cord connection portion 8*a*, terminal contact portion 8*b*, and an enlarged base portion 8*c* between them. The terminal contact portion 8*b* has an axial slit 20*a* and a circumferential channel 21*a* at the front portion.

Figure 8:
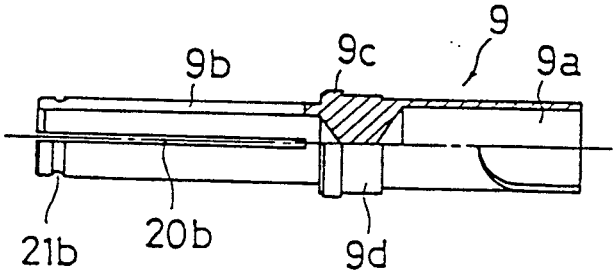
FIG. 8 is a partially cutaway side elevational view of a ground terminal.

In FIG. 8, the ground terminal 9 has a cord connection portion 9*a*, a terminal contact portion 9*b*, and an enlarged base portion 9*c* between them. The enlarged base portion 9*c* has a reduced ground member mounting portion 9*d*. The terminal contact portion 9*b* has an axial slit 20 and a circumferential channel 21*b* in the front portion.

Figure 9:
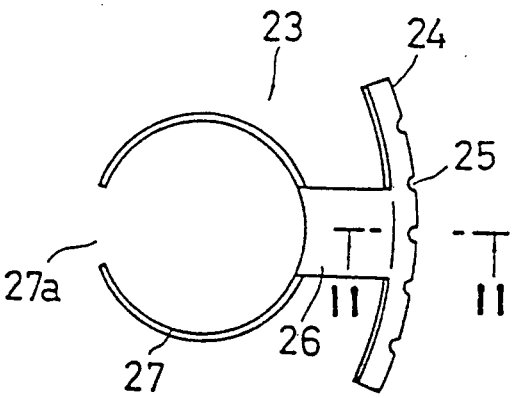
FIG. 9 is a top plan view of a ground member.
Figure 10:
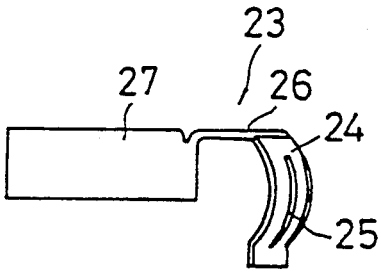
FIG. 10 is a side elevational view of the ground member.
Figure 11:
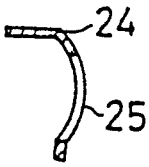
FIG. 11 is a sectional elevational view of taken along line 11—11 of FIG. 10.

In FIGS. 9–11, the ground member 23 has a rectangular arcked comb contact 24 made from a sheet metal. The comb contact 24 is curved outwardly and has a number of slits 25 arranged at regular intervals across the comb contact 24. A circular mount strap 27 with an opening 27*a* is linked to the comb contact 24 by a linkage piece 26.

Figure 12:
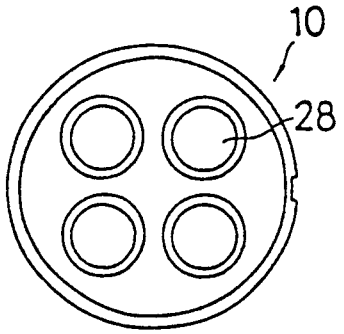
FIG. 12 is a rear elevational view of a retainer disk.
Figure 13:
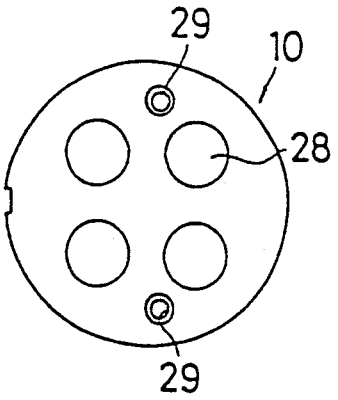
FIG. 13 is a front elevational view of the retainer disk.
Figure 14:
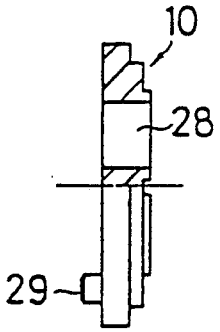
FIG. 14 is a partially sectional, side elevational view of the retainer disk.

In FIGS. 12–14, the retainer disk 10 is made from a synthetic resin and has four contact apertures 28 formed at equidistance from each other. A pair of positioning studs 29 extend forwardly from the retainer disk 10.

As best shown in FIG. 2, a spring ring 30 is put on each of the circumferential channels 21*a* and 21*b* of three female terminals 8 and one ground terminal 9, and the mounting strap 27 of the ground member 23 is fitted over the mounting portion 9*d* of the ground terminal 9. The three female terminals 8 and the ground terminal 9 are mounted in the terminal mounting apertures 22 such that the comb contact 24 and the linkage piece 26 are fitted in the ground terminal mounting recess 20 and the channel 23, respectively.

In FIG. 15, the insulation housing 7 is put in the conductive shell 6 by sliding the guide ridge 17 of the conductive shell 6 along the guide channel 21 of the insulation housing 7 for positioning. At this point, part of the comb contact 24 of the ground member 23 is brought into close contact with the inside wall of the conductive shell 6 breaking the lacquer coating into contact with the ground metal of the conductive shell 6 for conduction. The retainer disk 10 is then fitted into the conductive shell 6 such that the female terminals 8 and the ground terminal 9 are put through the terminal through holes 28. A stopper ring 32 is then fitted in an annular space made by the annular groove 33 of the conductive shell 6 and the annular groove 40 of the retainer disk 10 to hold the insulation housing 7 and the retainer disk 10 in place, thus completing the connector block 3.

The coupling ring 4 is mounted on the connector block 3 such that the inner flange engages the exterior flange 14 of the conductive shell 6 for rotation. The cord ring 5 is threaded over the conductive shell 6. Respective cords (not shown) are soldered to the cord connection portions 8*a* and 9*a* of the female terminals 8 and the ground terminal 9 to complete the plug 1.

Referring back to FIG. 1, the electrical receptacle 2 has a cylindrical shell 34 and a square mounting flange 35 extending outwardly from the cylindrical shell 34.

In FIG. 15, an annular stopper flange 36 is formed on the inside of the cylindrical shell 34. A terminal support member 37 and a waterproof packing 38 are held one upon another within the receptacle shell 34 between the stopper flange 36 and the stopper ring 39*a* which is fitted in the annular channel 39 of the receptacle shell 34. Four male terminals 40 are mounted in the terminal support member 37 at equidistance from each other through the waterproof packing 38. Cords (not shown) are soldered to the cord connection portions 40*a* of the male terminal 40 of the completed receptacle 2. The receptacle 2 is affixed to an equipment panel, for example, by screwing the mounting flange 35.

The coupling section 12 of the conductive shell 6 is plugged into the receptacle shell 34 of the receptacle 2 such that the male terminals 40 are fitted into the female terminals 8 and the ground terminal 9 for electrical connections. The guide ridge of the receptacle shell 34 is inserted into the guide channel 15 of the conductive shell 6 for guiding. Then, the coupling ring 4 is threaded over the receptacle shell 34 to connect the plug I to the receptacle 2. Consequently, the ground terminal 9 is grounded to the equipment panel via the ground member 23, the conductive shell 6, and the receptacle shell 34.

According to the invention, the ground terminal 9 can be mounted in a given terminal mounting aperture 22 of the insulation housing 7 such that the ground member 23 is fitted in the ground member recess 20. When the insulation housing 7 is put into the conductive shell 6, the comb contact 24 of the ground member 23 is brought into close contact with the inside wall of the conductive shell 6, breaking the coating of the conductive shell 6 and coming into contact with the ground metal of the conductive shell 6. Thus, the ground terminal 9 and the ground member 23 can be mounted in any terminal mounting aperture 22 of the insulation housing 7 for the plug 1.

Since the linkage piece 26 of the ground member 23 is held firmly between the retainer member 10 and the insulation housing 7, the electrical connector is useful in places which are subjected to vibrations or frequent plugging operations without suffering from loose contact between the ground terminal 9 and the ground member 23. In addition, the ground member 23 is not exposed, there is little or no danger of causing shortcircuit by falling metallic pieces, etc. and coming into contact with the hand, thereby increasing the safety of the electrical connector.

We claim:

1. An electrical connector comprising:

a conductive shell made from a conductive material;

an insulation housing placed within said conductive shell and having at least two terminal mounting apertures, at least two ground member mounting recesses formed on a side surface thereof, and at least two linkage channels formed on a rear surface thereof for linking said ground member mounting recesses to said terminal mounting apertures;

at least one detachable terminal mounted in one of said terminal mounting apertures;

a detachable ground terminal mounted in the other terminal mounting aperture;

a retainer member for retaining said detachable terminal and said detachable ground terminal in said insulation housing; and a detachable ground member with a circular mount strap attached to said ground terminal and having a linkage piece held between said retainer member and one of said linkage channels of said insulation housing, thereby securing said ground member to one of said terminal apertures.

2. The electrical connector of claim 1, wherein said ground member has a comb contact portion which is put in said ground member mounting recess so that it is brought into contact with an inside wall of said conductive shell.

3. The electrical connector of claim 1, wherein said circular mount strap has an opening to provide a spring property.

* * * * *